United States Patent [19]

Hatori et al.

[11] Patent Number: 4,959,689

[45] Date of Patent: Sep. 25, 1990

[54] ELECTROPHOTOGRAPHIC PLATE-MAKING MACHINE WITH INDEPENDENT MOTORS FOR MOVING THE COPY HOLDER, CONVEYING ROLLERS AND FOCUS REGION ROLLERS

[75] Inventors: Nobuyoshi Hatori; Tamio Iwamoto, both of Tokyo; Akira Kobashikawa, Okinawa, all of Japan

[73] Assignee: Iwatsu Electric Co., Ltd., Tokyo, Japan

[21] Appl. No.: 428,069

[22] Filed: Oct. 26, 1989

[30] Foreign Application Priority Data

Oct. 29, 1988 [JP] Japan ..... 63-271973

[51] Int. Cl.[5] ..... G03G 15/28; G03G 21/00

[52] U.S. Cl. ..... 355/233; 355/309

[58] Field of Search ..... 355/200, 210, 233–235, 355/309, 311, 317, 23–25, 50, 51, 57, 64, 65

[56] References Cited

U.S. PATENT DOCUMENTS 4,602,866 7/1986 Sakata et al. ..... 355/51 X
4,653,008 3/1987 Kai et al. .
4,681,313 7/1987 Yokoyama et al. .

FOREIGN PATENT DOCUMENTS 61-4065 1/1986 Japan .

*Primary Examiner*—Arthur T. Grimley
*Assistant Examiner*—William J. Royer
*Attorney, Agent, or Firm*—Paul and Paul

[57] ABSTRACT

An electrophotographic plate-making machine including a light source and a movable copy holder forming a scanning exposure system for focusing a light at a focus region. A first electric motor is connected to the copy holder, and a sensitive paper is conveyed by a plurality of conveying rollers. Two of the conveying rollers are arranged at the focus region in series with the remaining conveying rollers. A second electric motor is connected to the conveying rollers and a third electric motor is connected to the focus region rollers. Accordingly, the first, second and third electric drive motors, respectively, can move the copy holder, the conveying rollers and the focus region rollers independently of each other, so that a first scanning exposure can be carried out on one portion of a sensitive paper and a second scanning exposure can be carried out on the remaining portion of the sensitive paper.

11 Claims, 10 Drawing Sheets

| Fig.8A |
| --- |
| Fig.8B |

ELECTROPHOTOGRAPHIC PLATE-MAKING MACHINE WITH INDEPENDENT MOTORS FOR MOVING THE COPY HOLDER, CONVEYING ROLLERS AND FOCUS REGION ROLLERS

BACKGROUND OF THE INVENTION

1. Field of the Invention

The present invention relates to an electrophotographic plate-making machine using a scanning exposure system and enabling a photo composing.

2. Description of the Related Art

Two type of electrophotographic plate-making machines are most widely used, i.e. a stationary exposure system and a scanning exposure system. Proposals have been made to use a stationary exposure system for carrying out photo composing i.e., grouping a plurality of pictures on a single sheet of sensitive paper (master paper) at different portions thereof from a common copy. For example, Japanese Unexamined Patent Publication No. 61-4065 discloses an electrophotographic plate making apparatus in which exposures from a light source are made twice on a sensitive paper, one exposure on the upper half of the sensitive paper and another on the lower half of the sensitive paper. In this case, an upper light shielding cover and a lower light shielding cover are provided to respectively cover the upper and lower halves of the sensitive paper. Namely, the lower half of the sensitive paper is covered by the lower light shielding cover when the upper half of the sensitive paper is to be exposed, and alternatively, the upper half of the sensitive paper is covered by the upper light shielding cover when the lower half of the sensitive paper is to be exposed.

Nevertheless, there have been no proposal for carrying out photo composing in a scanning exposure system, as it appears that arrangement of the conventional scanning exposure system makes it impossible to apply a light shielding cover of the above described type to such a scanning exposure system.

SUMMARY OF THE INVENTION

The object of the present invention is to provide an electrophotographic plate-making machine which enables photo composing to be carried out in a scanning exposure system.

According to the present invention, there is provided an electrophotographic plate-making machine comprising a casing having a wall means provided with a slit for allowing a light beam to pass therethrough, a feeding means for feeding a sensitive paper, and an outlet for a treated sensitive paper, a copy holder arranged on the wall means and movable toward and away from the slit, a first electric drive motor operatively connected to and able to move the copy holder, a light source adapted for effecting a scanning exposure and arranged in the casing to direct a light beam onto a copy carried by the copy holder, an optical unit arranged in the casing so that a light beam reflected at the copy passes through the optical unit and is focused at a focus region, means for conveying a sensitive paper from the paper feeding means to the paper outlet along a predetermined travel path through the focus region, the conveying means comprising a plurality of conveying roller means arranged along the travel path and at least one focus region roller means arranged at the focus region in series with the conveying roller means, the focus region roller means being operative independently of the conveying roller means, a second electric drive motor operatively connected to and able to move the conveying roller means, and a third electric drive motor operatively connected to and able to move the focus region roller means whereby the first, second and third electric drive motors, respectively, are able to move the copy holder, the conveying roller means and the focus region roller means independently of each other, so that a first scanning exposure can be carried out on a portion of a sensitive paper carried by the focus region roller means while the copy holder is moved in one direction toward the slit, then the copy holder is moved in the reverse direction while the sensitive paper is held at the focus region, and then a second scanning exposure can be carried out on the remaining portion of the sensitive paper while the copy holder is again moved in one direction toward the slit.

With this arrangement, the third electric drive motor is particularly provided solely for the focus region roller means, and thus the focus region roller means can be operated independently of the other conveying roller means. Therefore, a first exposure can be carried out on a portion of a sensitive paper while the copy holder is moved in one direction toward the slit together with the focus region roller means, regardless of whether or not conveying roller means is driven. Then the copy holder is returned while the sensitive paper is held at the focus region, so that, for example, the sensitive paper does not reach the following development station, and a second exposure can be then carried out on the remaining portion of the sensitive paper.

BRIEF DESCRIPTION OF THE DRAWINGS

The present invention will become more apparent from the following description of the preferred embodiment with reference to the accompanying drawings, in which.

DESCRIPTION OF THE PREFERRED EMBODIMENT

Figure 1:
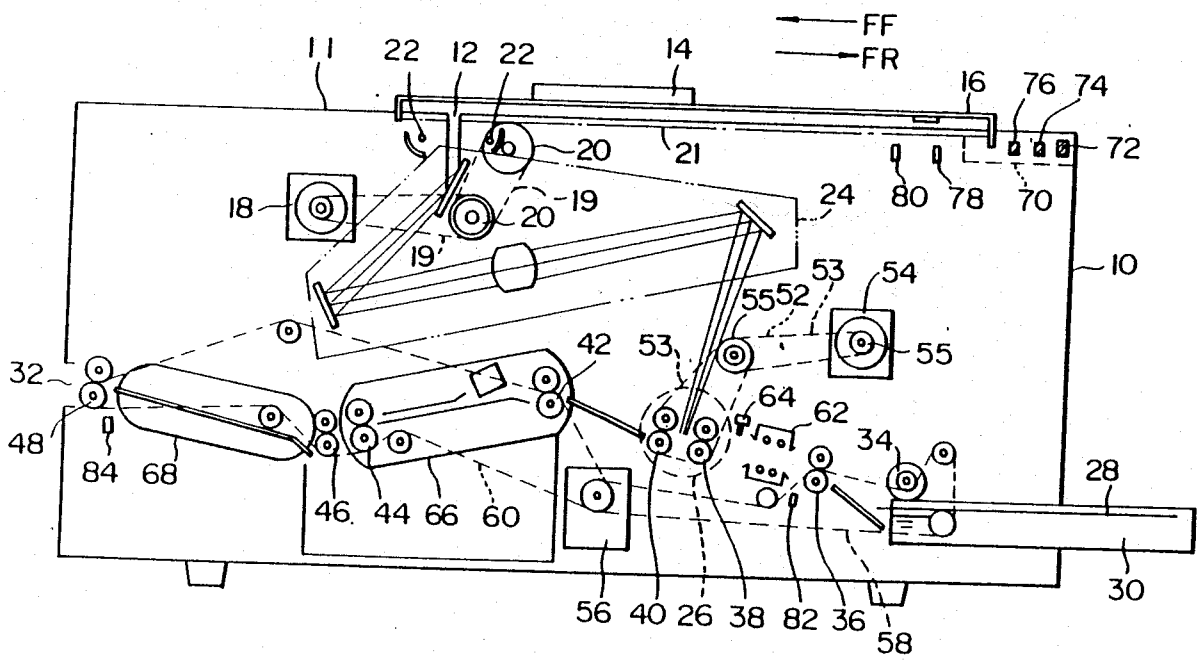
FIG. 1 is a diagrammatic view of an electrophotographic plate-making machine according to the present invention.

Referring to FIG. 1, the electrophotographic plate-making machine according to the present invention comprises a casing 10 with a top wall 11 having an exposure slit 12 provided therein and a copy holder 16 arranged on the top wall 11, for setting a copy 14 thereon. The copy holder 16 can move reciprocally relative to the exposure slit 12, as shown by the arrows FF and FR, to this end, an electric drive motor 18 is connected to the copy holder 16 by a transmission mechanism consisting of belts 19, pulleys 20, and a wire 21. Exposure lamps 22 of a known type adapted for effecting a scanning exposure are arranged in the casing 10 to direct a light beam onto the slit 12, and the light beam is reflected at the copy 14 and passes through a predetermined light path. An optical unit 24 consisting of mirrors and a lens is provided to pass the reflected light beam therethrough to be focused at a focus region 26.

A feeder 30 for a sensitive paper 28 is provided at the lower area of the casing 10 on one side thereof and an outlet 32 is provided on the opposite side thereof. A travel path is formed from the feeder 30 to the outlet 32, via the focus region 26, for conveying a sensitive paper 28 therealong. The feeder 30 includes a feed roller 34, and the travel path is constituted mainly by conveying roller 36, 38, 40, 42, 44, 46 and 48. Each of these conveying rollers 36, 38, 40, 42, 44, 46 and 48 is associated with a respective contacting roller, to thus constitute a pinch roller pair between which the sensitive paper 28 is pinched and conveyed. Note, appropriate guide plates or the like can be arranged between the adjacent rollers.

Among these conveying rollers, two conveying rollers 38 and 40 are arranged at the focus region 26, and the sensitive paper 28 can be held by the two conveying rollers 38 and 40 in a straight position so that an image of the copy 14 is focused on the sensitive paper 28 at the center of two conveying rollers 38 and 40. These two pairs of conveying rollers 38 and 40 are hereinafter referred to focus region rollers, to distinguish them from the other conveying rollers 36, 42, 44, 46 and 48. The focus region rollers 38 and 40 are exclusively connected to an electric focus region drive motor 54 through a transmission 52 including belts 53 and pulleys 55. Further an electric sensitive paper drive motor 56 is connected to the feed roller 34 and to the conveying roller 36 via a chain 58, and to the conveying rollers 42, 44, 46 and 48 via a chain 60. Furthermore a charging device 62 is provided between the conveying roller 36 and the focus region roller 38, and a static eliminating lamp 64 is provided between the charging device 62 and the focus region roller 38. Also, a development station 66 is provided between the conveying rollers 42 and 44, and a fixing station 68 is provided between the conveying rollers 46 and 48. Hereinafter, the conveying roller 42 is referred to as the development inlet roller.

A manual control panel 70 is provided at the top of the casing 10, and a print key 72, a composing select key 74, and a composing numeral input key (or a set of buttons) 76 are provided in the manual control panel 70. The composing select key 74 is operated when a photo composing plate-making operation is selected. The composing numeral input key 76 is used to input numerals necessary for effecting a photo composing plate-making process in accordance with the size of the copy 14 or the like. The print key 72 is operated at the start of a plate-making operation.

Further, a home position sensor 78 and a start position sensor 80 are provided for detecting the position of the copy holder 16, and to detect the position of the sensitive paper 28, a reference position sensor 82 is arranged the inlet side of the charging device 62, and a discharge sensor 84 is arranged near the outlet 32. The electrophotographic plate-making machine according to the present invention is operated in accordance with the operations of the keys and the outputs of the sensors, and to this end, a control unit 86 is provided, as shown in Fig, 3. The control unit 86 comprises a microcomputer which includes a central processing unit (CPU) 88 having arithmetic and control functions, a read only memory (ROM) 90 storing a program, a random access memory (RAM) 92 storing data or the like, a clock generator 94 generating timing signals, and a timer 93 measuring operation timings. These elements are interconnected by bus 96. An input and output (I/O) interface 98 is provided to receive signals from the above-described keys and sensors, such as the print key 72, the composing select key 74, the composing numeral input key 76, the home position sensor 78, the start position sensor 80, the reference position sensor 82, the discharge sensor 84, and so on, and to output control signals to the motors, such as the copy holder drive motor 18, focus region roller drive motor 54, and the sensitive paper drive motor 54, and to the exposure lamp 22, the charging device 62, and the static eliminating lamp 64.

Figure 2:
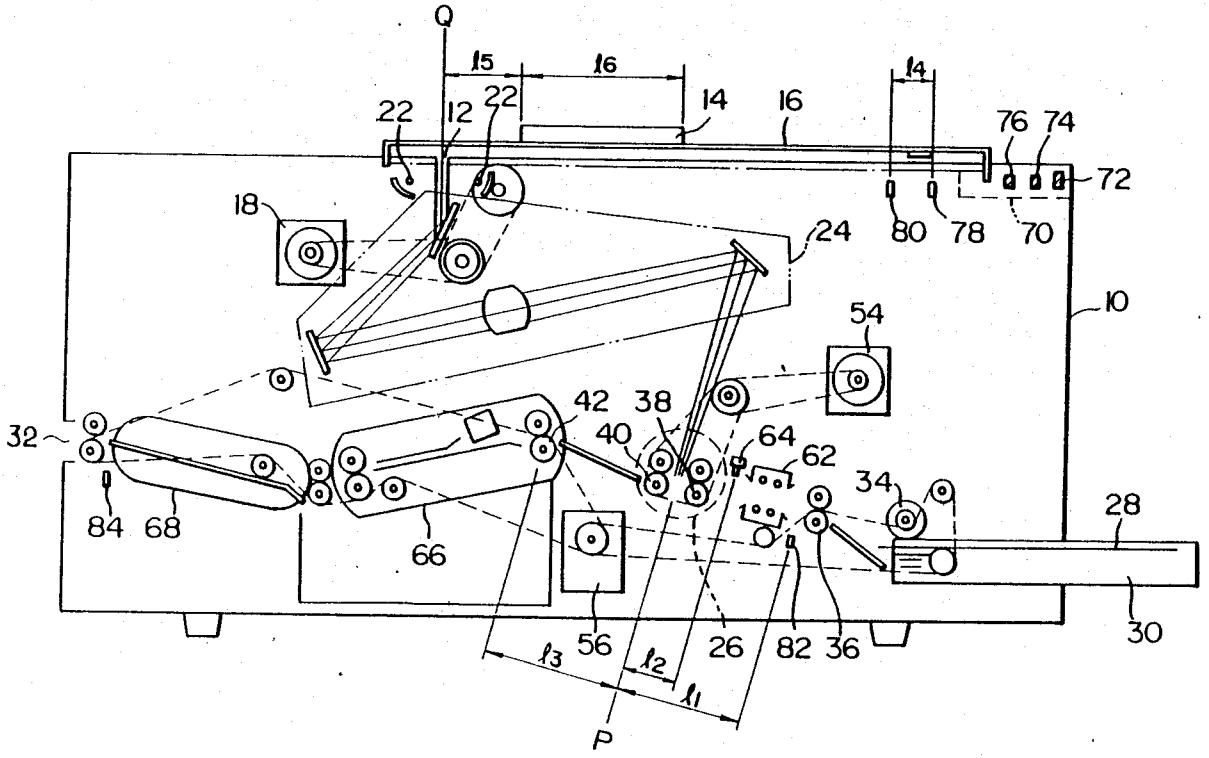
FIG. 2 is a view similar to FIG. 1 with dimensional relationships inserted.
Figure 3:
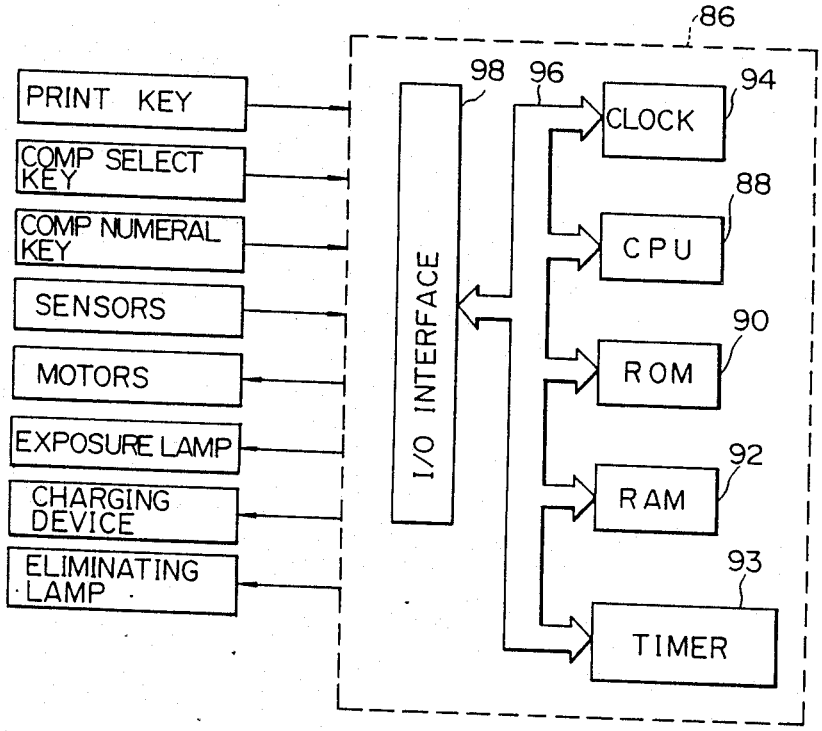
FIG. 3 is a diagrammatic arrangement of a control unit.

FIG. 2 is a view similar to FIG. 1 but having the dimensional relationships of several parts inserted therein. In FIG. 2, "$l_1$" represents the distance between the reference position sensor 82 for the sensitive paper 28 and the focus point P at the center of the focus region 26 formed by the focus region rollers 38 and 40; "$l_2$" the distance between the static eliminating lamp 64 and the focus point P; "$l_3$" the distance between the focus point P and the development inlet roller 42; "$l_4$" the distance between the home position sensor 78 and the start position sensor 80 for detecting the position of the copy holder 16; "$l_5$" the distance between the exposure position Q and the leading edge of the copy 14 when the copy holder 16 is at the home position and "$l_6$" the plate-making dimension of the copy 14 input by the composing numeral input key 76.

Figure 7:
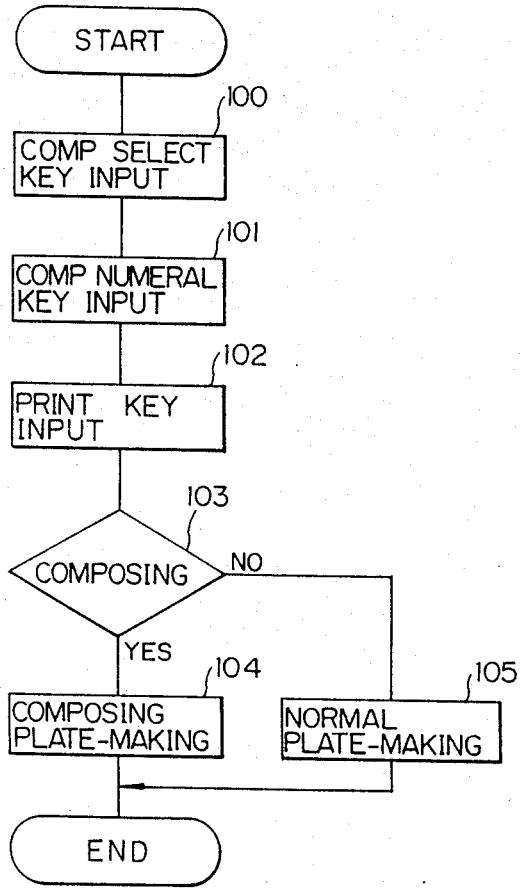
FIG. 7 is a flow chart of the process of a general plate-making operation.

FIG. 7 is a general flow chart of the program executed by the control unit 86. At steps 100 to 102 in FIG. 7, the operating conditions of the print key 72, the composing select key 74, and the composing numeral input key 76 are respectively determined, and at step 103, it is determined whether or not the composing plate-making process is selected. If the result is YES, the program proceeds to step 104 to carry out the composing plate-making process, and if the result is NO, the program proceeds to step 105 to carry out the normal plate-making process.

Figure 6:
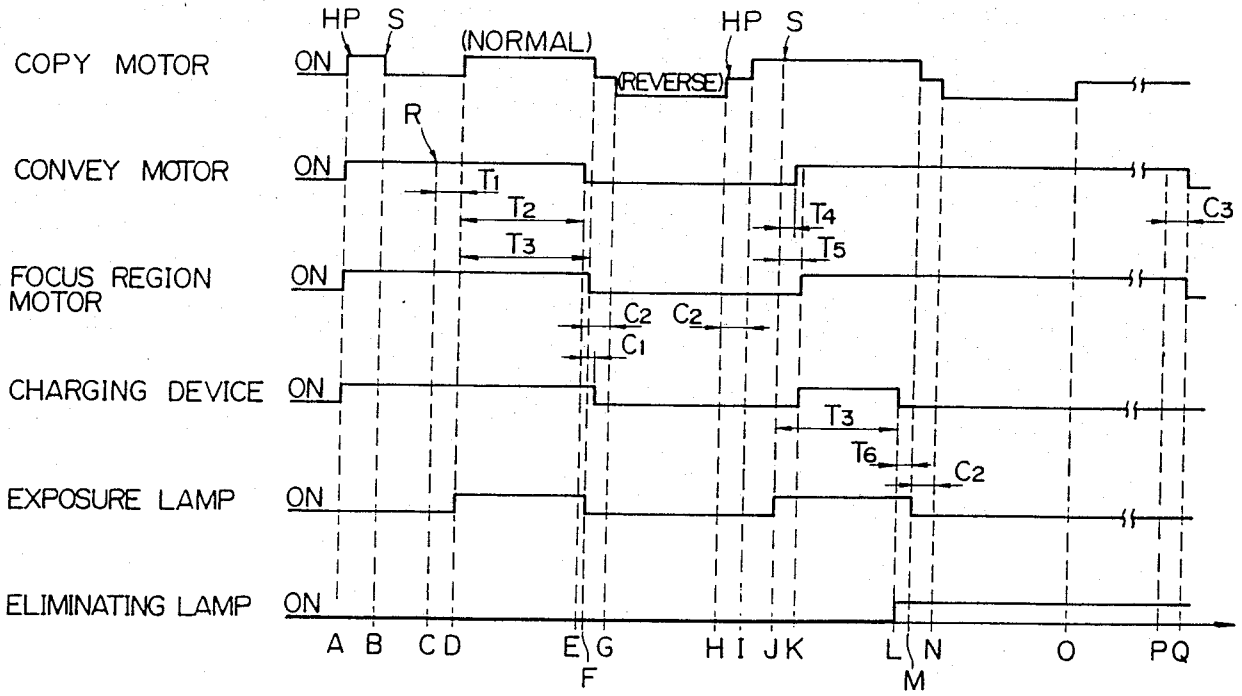
FIG. 6 is a timing chart illustrating the operation of several parts of the plate-making machine.
Figures 8, 8A:
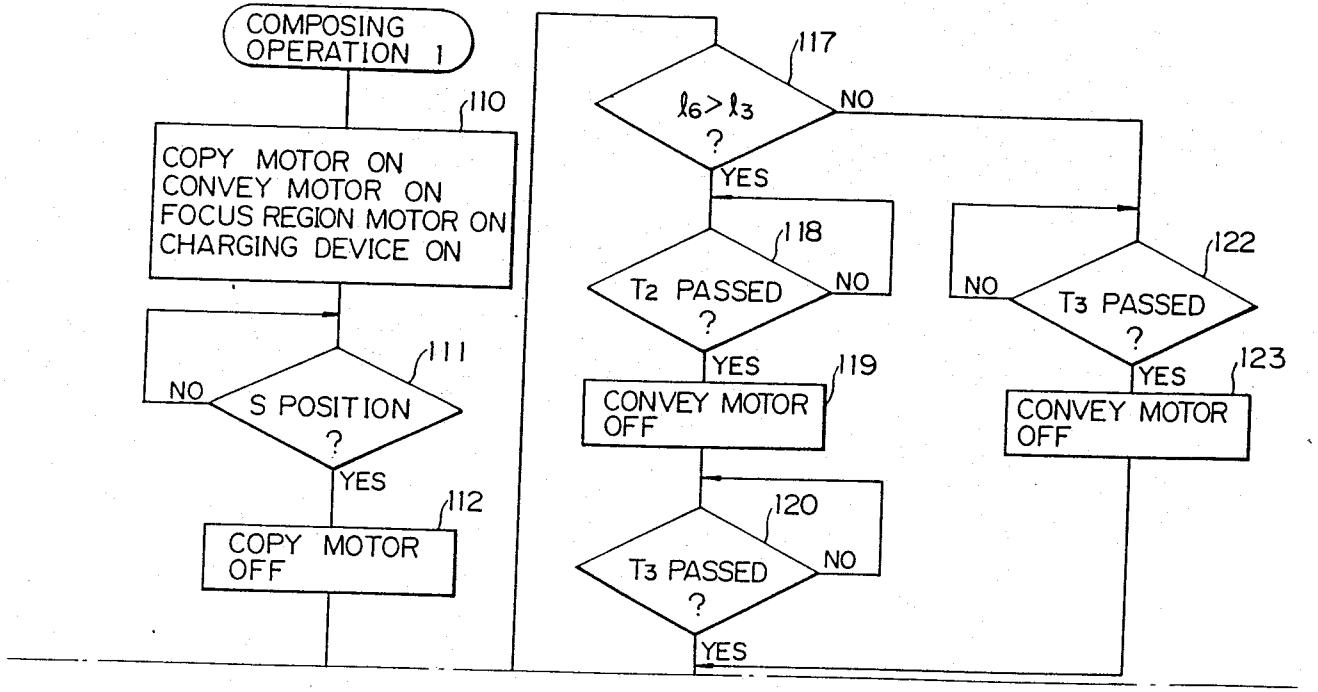
FIGS. 8A, 8B, 9A, 9B and 10 are consecutive flow charts of the process of a photo composing plate-making operation in detail.
Figure 8B:
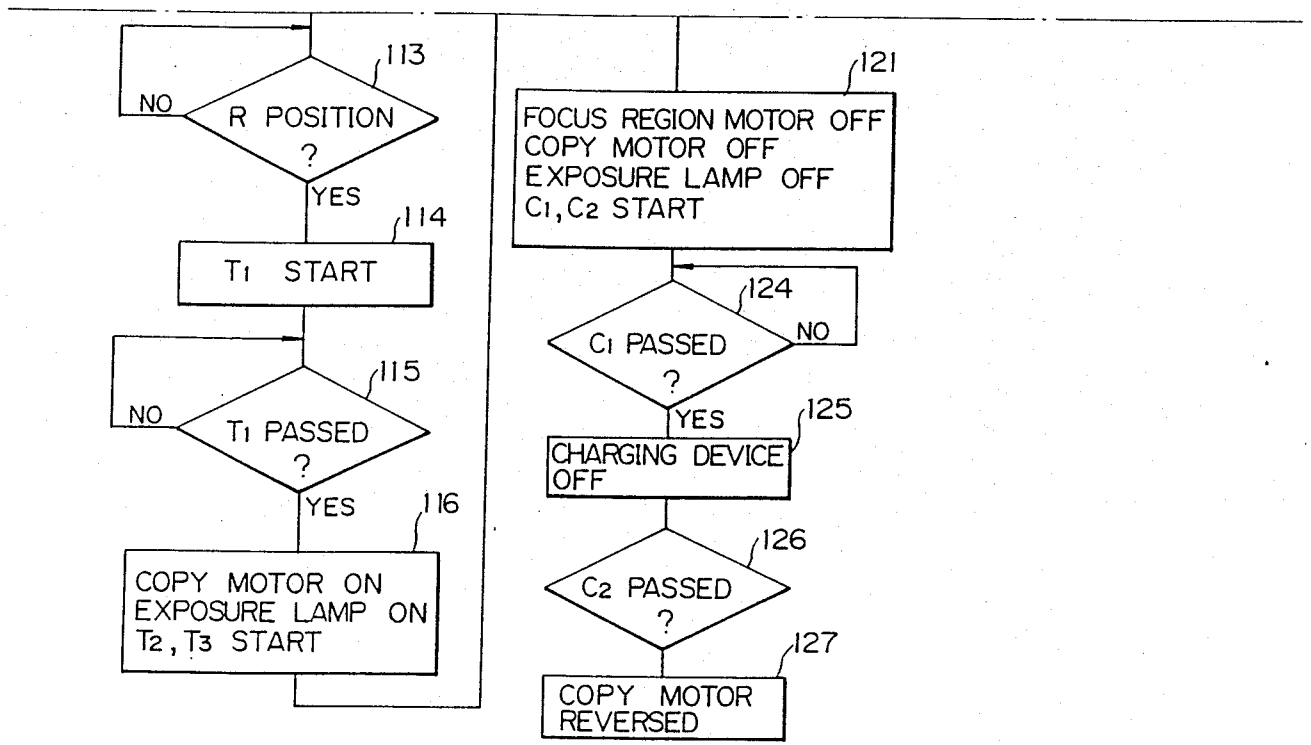
Figure 9A:
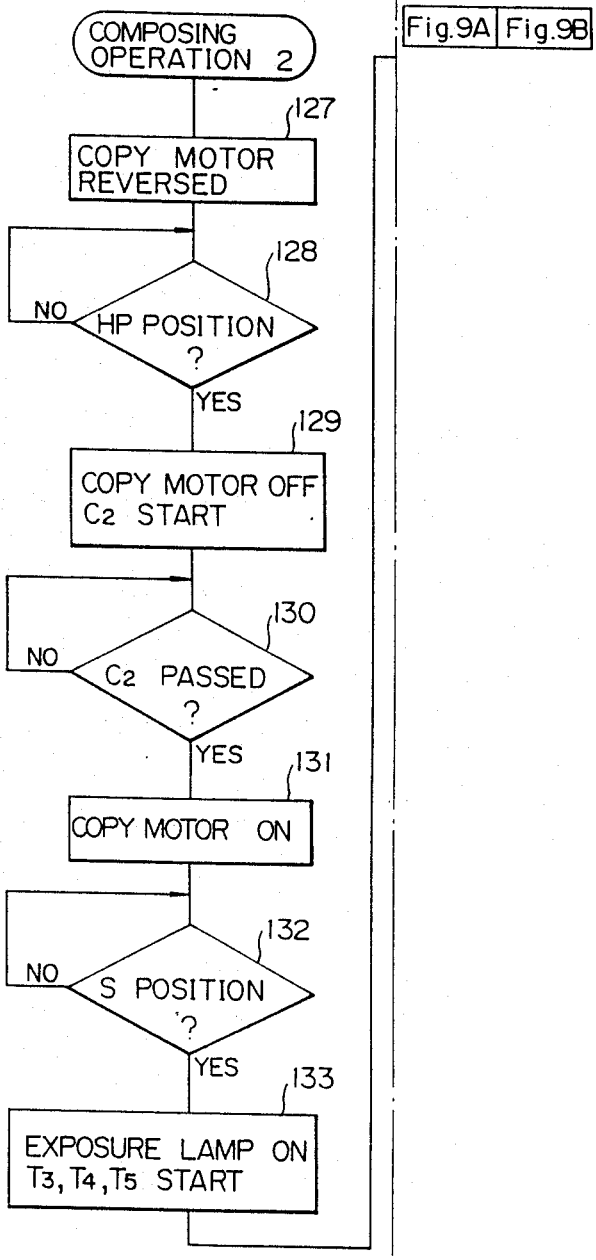
Figure 9B:
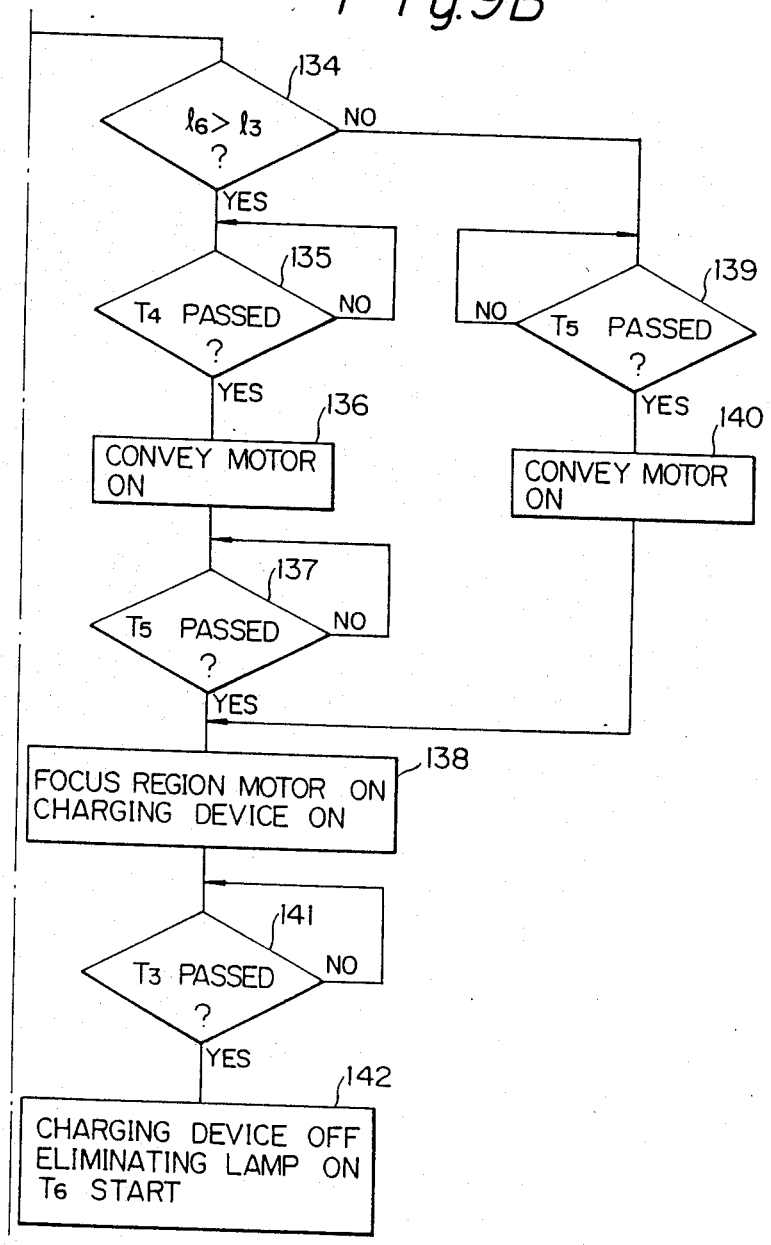
Figure 10:
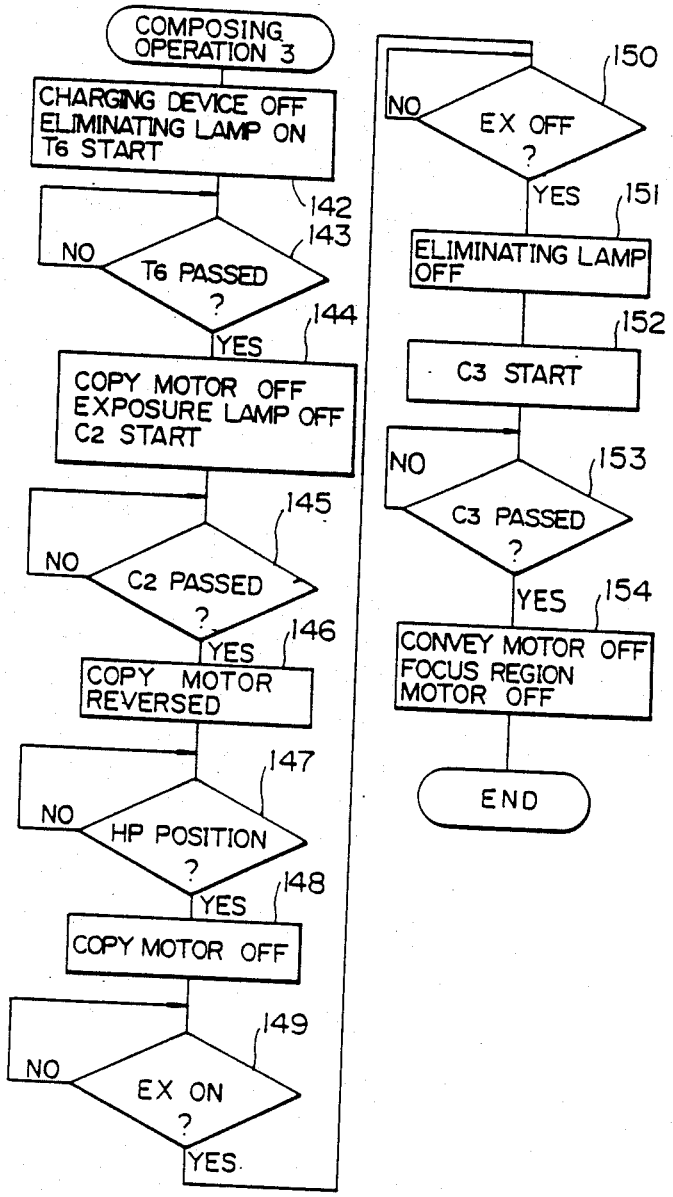

FIGS. 8 to 10 are flow charts showing the details of the process of the composing plate-making operation, i.e., the details of step 104 which is selected by the result at step 103 in FIG. 7. The details of step 105 are not described here. Also, FIG. 6 is a timing chart illustrating the operation of the composing plate-making process carried out according to FIGS. 8 to 10.

When it is determined at step 102 in FIG. 7 that the print key 72 has been operated, and at step 103 that the composing plate-making process has been selected, the program proceeds to step 110 in FIG. 8, and the electric copy drive motor (copy motor) 18, the electric sensitive paper drive motor (convey motor) 56, the electric focus region roller drive motor (focus region motor) 54, and the charging device 62 are all switched ON. This sitiation corresponds to the point A in FIG. 6, in which the copy holder 16 is initially at the home (HP) position. Therefore, the copy 14 and the sensitive paper 28 are advanced simultaneously. Then, at step 111, it is determined whether or not the copy holder 16 has reached the start (s) position. Since the copy motor 18 is driven together with the convey motor 56, the result at step 111 will become YES after an elapse of a certain time, and the program then proceeds to step 112 to stop the copy motor 18 only (point B in FIG. 6). Therefore, the copy 14 is stopped at the advanced distance $l_4$ and the only sensitive paper 28 only is further advanced.

Then at step 113, it is determined whether or not the sensitive paper 28 has reached the reference (R) position. In this case too, the result at step 113 will become YES after an elapse of a certain time, and the program then proceeds to step 114 to start the timer $T_1$ (point C in FIG. 6). Note, in the preferred embodiment, timers $T_1$ to $T_6$ are used to count the respective times which are conversions of the distances travelled by the copy holder 16 and the sensitive paper 28, and timers $C_1$ to $C_3$ are used to count the time elapsed. In the example, the copy holder 16 and the sensitive paper 28 travel at the same speed, for example, at 70 millimeters per second. In this case, the timer $T_1$ is selected to indicate a start timing of the copy motor 18 from the start position so that the sensitive paper 28 reaches the focus position (P) at the same time as the leading edge of the copy 14 reaches the exposure position (Q). The respective timers can be selected to have the following relationships. The term $(l_5-l_4)/70$ is equal to the travel time of the copy 14 from the starting position (S position) to the exposure position (Q position).

$$T_1 = [l_1 - (l_5 - l_4)]/70$$
$$T_2 = [(l_5 - l_4) + l_3]/70$$
$$T_3 = [(l_5 - l_4) + l_6]/70$$
$$T4 = [(l_5 - l_4) - (l_6 - l_3)]/70$$
$$T_5 = (l_5 - l_4)/70$$
$$T_6 = l_2/70$$
$$C_1 = 0.2 \text{ sec.}$$
$$C_2 = 0.5 \text{ sec.}$$
$$C_3 = 1.0 \text{ sec.}$$

At step 115 in FIG. 8, it is determined whether or not the timer $T_1$ has counted a predetermined value. If the result is YES, the program proceeds to step 116 and the copy motor 18 is started, and therefore after a predetermined time, the sensitive paper 28 will reach the focus position (P) at the same time as the leading edge of the copy 14 reaches the exposure position (Q). Also, the exposure lamps 22 are switched ON and the timers $T_2$ and $T_3$ are started (point D in FIG. 6).

Then, at step 117, it is determined whether or not the distance $l_6$ is greater than the distance $l_3$. A YES result means that the length of the copy 14 is greater than the distance between the focus point P and the development inlet roller 42. Namely, in this case, the leading edge of the sensitive paper 28 will pass beyond the development inlet roller 42 when an exposure of the entire surface of the copy 14 is made. At this point, in the preferred embodiment, the program proceeds to step 118 and it is determined whether or not the timer $T_2$ has passed the predetermined value (the leading edge of the sensitive paper 28 has reached the development inlet roller 42). If the result is YES, the convey motor 56 is stopped at step 119 (point E in FIG. 6). Then, at step 120, it is determined whether or not the timer $T_3$ has passed the predetermined value (exposure of the entire surface of the copy 14 is completed). This is the point F in FIG. 6, and the convey motor 56 is stopped before this point F.

Figure 4:
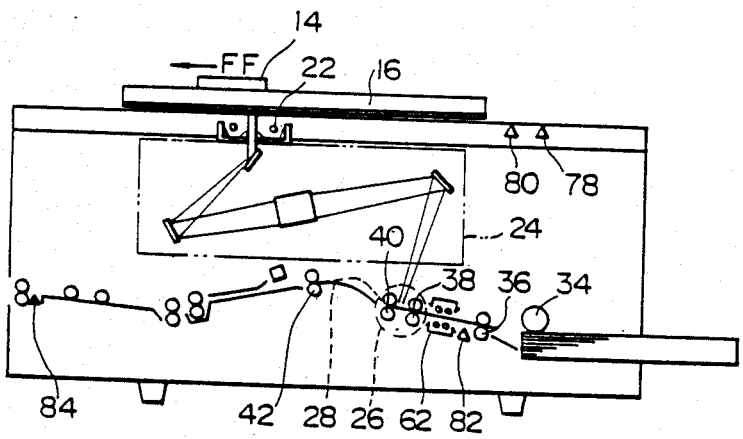
FIGS. 4 and 5 are views, illustrating respective operations of the plate-making machine.

This condition is shown in FIG. 4, in which the leading edge of the sensitive paper 28 is received by but does not advance beyond the development inlet roller 42, since the convey motor 56 is stopped, and operation of the focus region motor 54 is continued so that the following portion of the sensitive paper 28 is advanced by the focus region rollers 38 and 40. Therefore, the sensitive paper 28 is curved in an arcuate shape to absorb the excess dimension between the development inlet roller 42 and the focus region rollers 38 and 40, and thus, local and excessive development of the sensitive paper 28 is prevented while it is stopped.

If the result at step 117 in FIG. 8 is NO, the program proceeds to step 122 and it is determined whether or not the timer $T_3$ has passed the predetermined value (exposure of the entire surface of the copy 14 is completed). If the result at step 122 is YES, the program proceeds to step 123 and the convey motor 56 is stopped. In this case, however, the sensitive paper 28 is not curved, different to the case shown in FIGS. 4 and 5, even when the exposure of the entire surface of the copy 14 is completed, since the length of the copy 14 is smaller than the distance between the focus point P and the development inlet roller 42.

Figure 5:
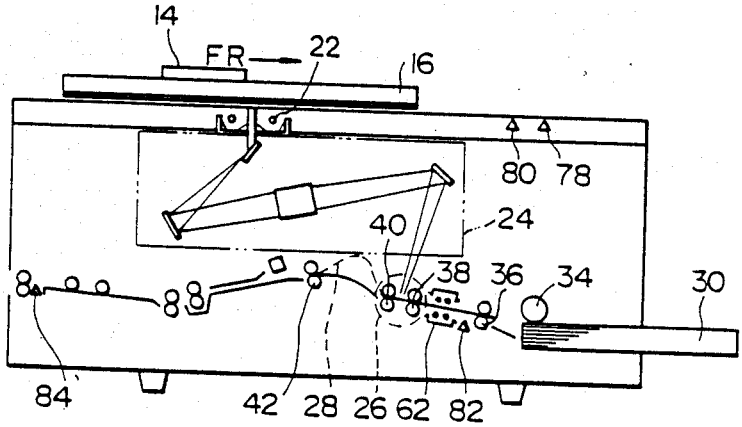

The program proceeds to step 121 after step 120 or 123, and the focus region motor 54, copy motor 18, and the exposure lamps 22 are switched OFF, respectively. At this step, the first scanning exposure is completed and the sensitive paper 28 is retained by the focus region rollers 38 and 40, which are now stopped. Also at step 121, the timers $C_1$ and $C_2$ are started, and then at step 124, it is determined whether or not the timer $C_1$ has passed the predetermined value. When the result is YES, the charging device 62 is switched OFF at step 125 to prevent overcharging. Then, at step 126, it is determined whether or not the timer $C_2$ has passed the predetermined value, and when the result is YES, the program proceeds to step 127. At step 127, the rotation of the copy motor 18 is reversed (point G in FIG. 6) to return the copy holder 16 to the home position, as shown in FIG. 5.

Referring next to FIG. 9, step 127 is again illustrated in FIG. 9 to show that FIG. 9 is consecutive to FIG. 8. Also, step 142 is illustrated in both FIGS. 9 and 10.

After step 127, wherein the rotation of the copy motor 18 is reversed the program proceeds to step 128 and it is determined whether or not the copy holder 16 has returned to the home position. When the result is YES, the program proceeds to step 129, the copy motor 18 is stopped, and the timer $C_2$ is set (point H in FIG. 6). Then, at step 130, it is determined whether or not the timer $C_2$ has passed the predetermined value. When the result at step 130 is YES the program proceeds to step 131 and the copy motor 18 is normally rotated (point I in FIG. 6) to move the copy holder 16 in the FF direction. Then, at step 132, it is determined whether or not the copy holder 16 has reached the start (S) position. When the judgement at step 132 is YES, the program proceeds to step 133, and at step 133, the exposure lamps 22 are switched ON and the timers $T_3$, $T_4$, and $T_5$ are started (point J in FIG. 6).

As described previously, the relationship that $T_5=(l_5-l_4)/70$, exists, and this relationship is the time required for the leading end of the copy 14 at the start position (P position) to travel to the exposure position (Q position). The relationship $T_4=[(l_5-l_4)-(l_6-l_3)]/70$ means that the convey motor 56 should be started before the copy 14 reaches the exposure position by the time component corresponding to the curved portion of the sensitive paper 28 between the development inlet roller 42 and the focus region rollers 38 and 40. That is, at step 134 it is determined whether or not the distance $l_6$ is greater than the distance $l_3$, and if the result at step 134 is YES, the program proceeds to steps 135 and 136 and the convey motor 56 is switched ON to extend the slack portion of the sensitive paper 28 by a rotation of the development inlet roller 42. The copy motor 18 is continuously driven throughout these steps, so that the leading end of the copy 14 will reach the exposure position (Q position) when the timer $T_5$ has counted the predetermined value determined at step 137. Thus, at step 138, the focus region motor 54 is switched ON to start the second scanning exposure (point K in FIG. 6), and at the same time, the charging device 62 is switched ON. If the result at step 134 is NO, it is determined whether or not the timer $T_5$ has passed the predetermined value at step 139, and the convey motor 56 is switched ON at step 140. Thereafter, the program proceeds to step 138 and then to step 141. At step 141, it is determined whether or not the timer $T_3$ has passed the predetermined value (exposure of the entire surface of the copy 14 is completed). If the result at step 141 is YES, the program proceeds to step 142 and the charging device 62 is switched OFF, the static eliminating lamp 64 is switched ON to eliminate the formation of after images, and the timer $T_6$ is started (point L in FIG. 6).

Referring to FIG. 10, at step 143 it is determined whether or not the timer $T_6$ has passed the predetermined value, and if the result is YES, the program proceeds to step 144. At step 144, the copy motor 18 and the exposure lamps 22 are switched OFF, and the timer $C_2$ is started (point M in FIG. 6). When it is determined at step 145 that the timer $C_2$ has counted the predetermined value, the rotation of the copy motor is reversed at step 146 (point N in FIG. 6). When it is determined at step 147 that the copy motor 18 has returned to the home position, the copy motor 18 is switched OFF at step 148 (point 0 in FIG. 6). Then at step 149, it is determined whether or not the discharge sensor (EX) 84 has generated an ON signal, and at step 150, it is determined whether or not the discharge sensor (EX) 84 has generated an OFF signal. When the results at steps 140 and 150 are YES, the static eliminating lamp 62 is switched OFF at step 151 (point P in FIG. 6). Finally, the timer $C_3$ is started at step 152, and at step 153 it is determined whether or not the timer $C_3$ has passed the predetermined value. When the result at step 153 is YES, the convey motor 56 and the focus region motor 54 are switched OFF and the process is completed (point 0 in FIG. 6).

As explained above, according to the present invention, an electrophotographic plate-making machine can be obtained by which a photo composing process can be automatically effected in a scanning exposure system, having the arrangement comprising a casing having a wall means provided with a slit for allowing a light beam to pass therethrough, a feeding means for feeding a sensitive paper, and an outlet for a treated sensitive paper, a copy holder arranged on the wall means and movable toward and away from the slit, a first electric drive motor operatively connected to and able to move the copy holder, a light source adapted for effecting a scanning exposure and arranged in the casing to direct a light beam on to a copy carried by the copy holder, an optical unit arranged in the casing so that a light beam reflected at the copy passes through the optical unit and is focused at a focus region, means for conveying a sensitive paper from the feeding means to the outlet along a predetermined travel path through the focus region, the conveying means comprising a plurality of conveying roller means arranged along the travel path and at least one focus region roller means arranged at the focus region in series with the conveying roller means, the focus region roller means being operative independently of the conveying roller means, a second electric drive motor operatively connected to and able to move the conveying roller means, and a third electric drive motor operatively connected to and able to move the focus region roller means, whereby the first, second and third electric drive motors, respectively, can move the copy holder, the conveying roller means and the focus region roller means independently of each other, so that a first scanning exposure can be carried out on a portion of a sensitive paper carried by the focus region roller means while the copy holder is moved in one direction toward the slit, the copy holder is returned in the reverse direction while the sensitive paper is held at the focus region, and then a second scanning exposure can be carried out on the remaining portion of the sensitive paper while the holder is again moved in one direction toward the slit.

We claim:

1. An electrophotographic plate-making machine comprising:

a casing having a wall means provided with a slit for allowing a light beam to pass therethrough, a feeding means for feeding a sensitive paper, and an outlet for a treated sensitive paper;

a copy holder arranged on said wall means and movable toward and away from said slit;

a first electric drive motor operatively connected to and able to move said copy holder;

a light source adapted for effecting a scanning exposure and arranged in said casing to direct a light beam on to a copy carried by said copy holder;

an optical unit arranged in said casing so that a light beam reflected at said copy passed through said optical unit and is focused at a focus region;

means for conveying a sensitive paper from said feeding means to said outlet along a predetermined travel path through said focus region, said conveying means comprising a plurality of conveying roller means arranged along said travel path and at least one focus region roller means arranged at said focus region in series with said conveying roller means, said focus region roller means being operative independently of said conveying roller means;

a second electric drive motor operatively connected to and able to move said conveying roller means; and a third electric drive motor operatively connected to and able to move said focus region roller means;

whereby said first, second and third electric drive motor, respectively, can move said copy holder, said conveying roller means and said focus region roller means independently of each other, so that a first scanning exposure can be carried out on a portion of a sensitive paper carried by said focus region roller means while said copy holder is moved in one direction toward said slit, said copy holder is returned in the reverse direction while said sensitive paper is held at said focus region, and then a second scanning exposure can be carried out on the remaining portion of the sensitive paper while said copy holder is again moved in one direction toward said slit.

2. An electrophotographic plate-making machine according to claim 1, wherein a charging station is provided between said feeding means and said focus region for charging static electricity to a sensitive paper and a development station is provided between said focus region and said outlet.

3. An electrophotographic plate-making machine according to claim 2, wherein a static eliminating station is provided between said charging station and said focus region.

4. An electrophotographic plate-making machine according to claim 2, wherein each of said conveying roller means and said at least one focus region roller means comprises a driven roller and a contact roller associated with said driven roller to form a pair of nip rollers.

5. An electrophotographic plate making machine according to claim 4, wherein said at least one focus region roller means comprises two driven rollers, and said conveying roller means including a first group of at least one driven roller between said feeding means and said at least one focus region roller means and a second group of driven rollers between said at least one focus region roller means and said outlet.

6. An electrophotographic plate-making machine according to claim 5, wherein said feeding means includes at least one feed roller which is driven by said second electric drive roller.

7. An electrophotographic plate-making machine according to claim 5, wherein one of said second group of driven rollers is arranged at an inlet position of said development station, said second electric drive motor is stopped before said third electric drive motor is stopped so that a sensitive paper is held between said one driven roller and said at least one focus region roller means in a slackened manner during the first scanning exposure.

8. An electrophotographic plate-making machine according to claim 5, wherein said third electric drive motor is stopped before second electric drive motor is stopped so that slack in the sensitive paper is extended between said one driven roller and said at least one focus region roller means during the second scanning exposure.

9. An electrophotographic plate-making machine according to claim 2, wherein said copy holder has a home position and a start position between said home position and said slit, whereby at the first scanning exposure, said copy holder is once moved from said home position to said start position, and then restarted from said start position to move toward said slit while said conveying roller means and said at least one focus region roller means are moved to convey a sensitive paper from said feeding means toward said focus region, and at the second scanning exposure, said copy holder is continuously moved from said home position to said slit and an operation of said at least one focus region roller means is started after said copy holder has moved beyond said start position.

10. An electrophotographic plate-making machine according to claim 2, wherein said copy holder has a home position and a start position between said home position and said slit, and a reference position is provided along said travel path, whereby at the first scanning exposure, said copy holder is once moved from said home position to said start position, and then restarted to be moved from said start position to said slit in a certain time selected in relation to the dimension of a copy to be printed after sensitive paper has reached said reference position, while said conveying roller means and said focus region roller means are operated to convey a sensitive paper from said feeding means toward said focus region, and at the second scanning exposure, said copy holder is continuously moved from said home position to said slit and the operation of said at least one focus region roller means is started after said copy holder has moved beyond said start position.

11. An electrophotographic plate-making according to claim 10, wherein a first means is provided for calculating said certain time in relation to a dimension of a copy to be printed after a sensitive paper has reached said reference position at the first scanning exposure, and a second means is provided for calculating a certain second time in relation to a dimension of a copy to be printed after said copy holder has reached said start position at the second scanning exposure.

* * * * *